United States Patent [19]

Beck

[11] 3,984,615

[45] Oct. 5, 1976

[54] ELECTRICAL RESISTANCE FURNACE HEATER

[75] Inventor: Jacob Howard Beck, Waban, Mass.

[73] Assignee: BTU Engineering Corporation, North Billerica, Mass.

[22] Filed: Oct. 14, 1975

[21] Appl. No.: 622,231

[52] U.S. Cl. ..... 13/25; 219/406; 219/532; 219/542; 219/552; 338/280; 338/282; 338/283

[51] Int. Cl.[2] ..... H05B 3/06; F27D 11/02

[58] Field of Search ..... 13/22, 25; 219/390, 219/395, 406, 411, 532, 542, 552, 553; 338/279, 280, 282, 283, 284, 287, 288, 289, 291, 292, 293

[56] References Cited

UNITED STATES PATENTS

| | | | |
|---|---|---|---|
| 1,432,442 | 10/1922 | Collins | 338/291 UX |
| 2,162,030 | 6/1939 | Piazzoli, Jr. | 13/25 |
| 3,214,572 | 10/1965 | Young | 13/25 X |
| 3,218,437 | 11/1965 | Laing | 338/282 |
| 3,697,923 | 10/1972 | Griffes | 338/283 X |

*Primary Examiner*—R. N. Envall, Jr.
*Attorney, Agent, or Firm*—Weingarten, Maxham & Schurgin

[57] ABSTRACT

A high temperature unitary electrical resistance heater which is mechanically supported throughout its active length but spaced from a refractory base with the heating element being substantially free of the supporting structure to provide an efficient heater having relatively low thermal inertia while being rigidly supported for high temperature operation. A flat continuous electrical resistor ribbon is disposed in a multiple loop configuration having a plurality of spaced heater segments with flat confronting surfaces and a plurality of legs outwardly extending from an edge of the ribbon and secured within a refractory base to support the ribbon in spaced relation to the refractory base.

11 Claims, 5 Drawing Figures

ELECTRICAL RESISTANCE FURNACE HEATER

FIELD OF THE INVENTION

This invention relates to heating elements for high temperature electrical furnaces, and more particularly to an electrical resistance heater formed of a continuous flat electrical resistance element folded in a serpentine or helical path and rigidly supported by a refractory means spaced from the heater.

BACKGROUND OF THE INVENTION

Heating coils employed in electrical furnaces operative at exceedingly high temperatures are typically supported by ceramic cores such as grooved plates or cylinders wherin the heater is supported and often confined throughout its entire length by the ceramic structure. The weight of the ceramic support structure constitutes a major percentage of the overall heater assembly mass by reason of the amount of ceramic necessary for support of the heating element and the inherent density of the ceramic material. As a result of the relatively massive amount of ceramic material present in a heater assembly of conventional construction, the heater exhibits a high thermal inertia which limits the rapidity with which a change of temperature can be accomplished. The response of such conventional heaters to temperature control is thereby limited by the relatively slow thermal response of the heater structure.

The function of the ceramic core in each of these prior heaters is to support and contain the electrical heating element. The core may be composed of a cylindrical rod or a circular or rectangular plate having a plurality of longitudinal re-entrant slots or grooves formed in the peripheral surface thereof and running the length of said surface. These grooves, due to the limitations imposed by the ceramic material, are necessarily of small diameter and will expose at the maximum one fifth the surface area of the electrical heating element itself. The ceramic core therefore effectively shades at least 80% of the direct radiation emitted by the coil of the product, thus providing a low standard of emissivity. This low emissivity in turn promotes a substantial differential in temperature between the product and the heating element, causing inefficiency and shorter heating life.

There are many other problems with heater coils set in grooves. When using a flat ceramic plate with a plurality of longitudinal parallel grooves formed in the plane of one surface, and placed above and below the materials and product being heated, the lower flat heater collects particles which must be cleaned or the heater will short circuit. The use of large amounts of ceramic material, small restraining grooves and relatively thin heating wire combine to yield poor tensile strength, an inefficient level of thermal inertia and a large temperature differential between the heater and the product.

Other heater configurations employ a solid heater rod which in one well-known configuration is wound in a circular helical configuration with ceramic spacers interposed between helix turns to maintain spacing. This type of heater depends on its radial arch for support, and the heater must support not only the weight of the rod, but also that of the ceramic spacers. At high temperatures, such rod heaters tend to sag, and in addition, the heating surface thereof is shaded by the presence of the ceramic spacers.

Examples of prior devices are shown in U.S. Pat. Nos. 2,870,308; 3,651 304; 3,673,387; 3,783,238 and 3,798,417. A high temperature heater which overcomes the deficiencies of the prior art is the subject of copending application Ser. No. 622235, filed of even date herewith, entitled HIGH TEMPERATURE FURNACE HEATER and assigned to the same assignee of the present invention.

SUMMARY OF THE INVENTION

Briefly, the present invention provides a high temperature unitary electrical resistance heater which is mechanically supported throughout its active length, but spaced from a refractory base with the heating element itself being substantially free of the supporting structure to provide an efficient heater having relatively low thermal inertia, while being rigidly supported for high temperature operation. The novel furnace heater comprises in one preferred embodiment a flat, continuous electrical resistor ribbon folded in a serpentine path to provide a planar configuration having a plurality of spaced, generally parallel flat confronting surfaces. A plurality of legs are formed with or affixed to the ribbon and extend outwardly in the planes of the flat confronting surfaces. The outermost ends of the plurality of legs are rigidly secured in a refractory base with the resistor ribbon being spaced along its active length from the confronting surface of the base. the legs, integral with the resistor ribbon, achieve rigid support of the resistor ribbon while providing only limted paths for thermal conduction from the ribbon to the refractory base. As a result, the refractory support forms no material part of the thermal heater control, and the resistor ribbon is more efficiently controllable to achieve faster heating and cooling.

The novel furnace heater can also be embodied in a helical configuration comprising a flat, continuous resistor ribbon formed into a helix with the flat confronting surfaces of the ribbon being generally transverse to the longitudinal axis of the helix. A plurality of legs are provided on the resistor ribbon and outwardly extend therefrom, these legs being secured by a cylindrical refractory base with the helical resistor ribbon being spaced from the confronting surface of the refractory cylinder and being disposed generally coaxially therewith.

The invention in both the planar and helical configuration provides a heater which is entirely open to the furnace chamber without the encumbrance of an enveloping ceramic support structure and without ceramic spacers between sections of the heater. Thus, the emissivity of the heater is increased and thermal inertia reduced. The heating element is operable over a long life and is unlikely to fracture during its operating lifetime. The increased radiation efficiency and lower thermal inertia of the heater also result in lower energy requirements and enhanced operational efficiency.

DESCRIPTION OF THE DRAWINGS

The invention will be more fully understood from the following detailed description taken in conjunction with the accompanying drawings in which.

DETAILED DESCRIPTION OF THE INVENTION

Figure 1:
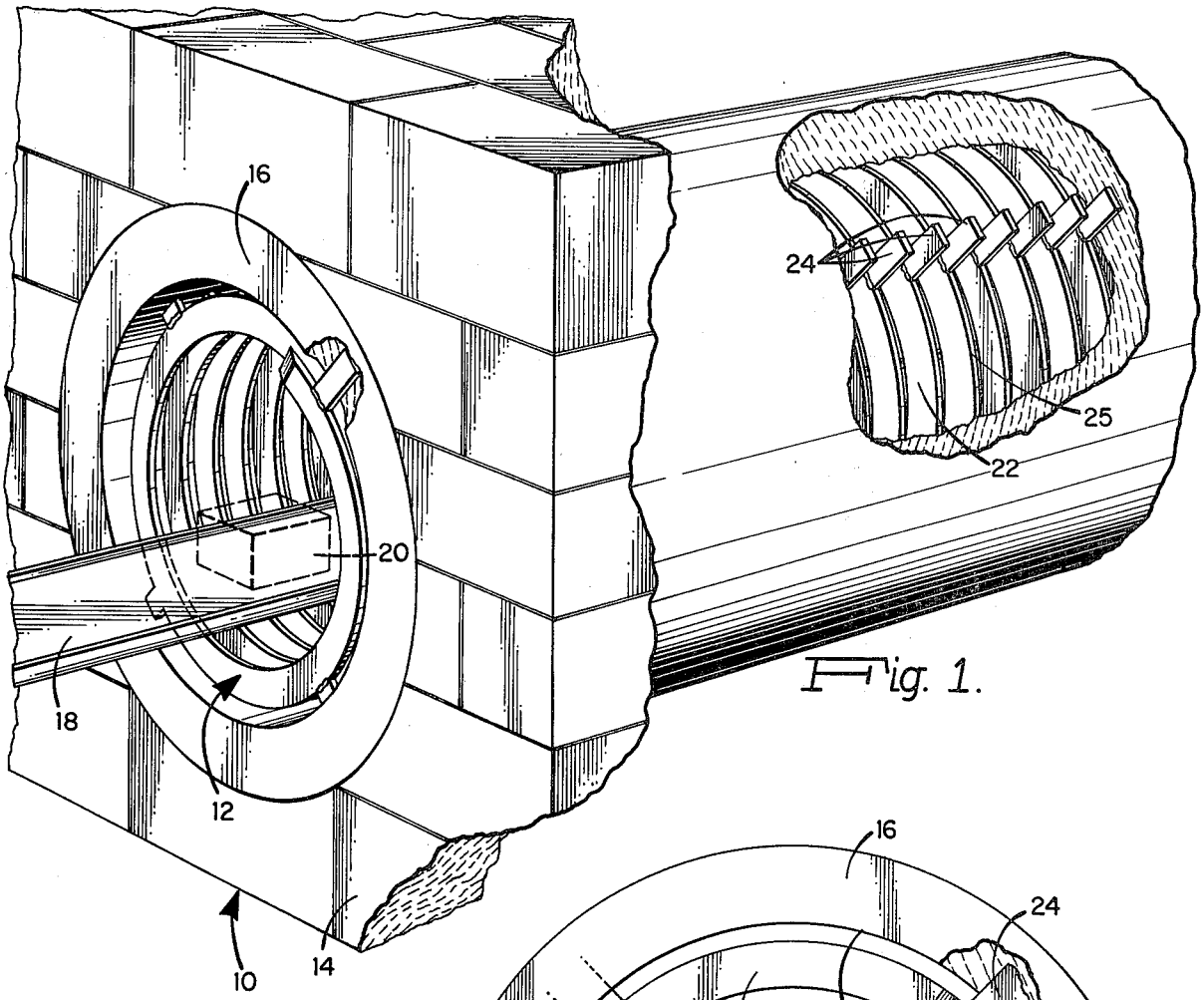
FIG. 1 is a partially cutaway diagrammatic representation of a furnace having a heating element constructed according to the invention.

Referring to FIG. 1, there is shown a furnace 10 having a helically configured electrical furnace heating element 12 constructed and operative in accordance with the present invention. The furnace 10 is typically formed of appropriate fire brick 14 which encloses an elongated generally cylindrical refractory base 16 within which is supported the helical electrical heating element 12. A conveyor 18 is disposed within the furnace chamber and extends through the chamber for transport of a product 20 through the furance for thermal processing. The details of the furnace and its conveyor have been omitted for clarity since these form no part of the present invention.

Figure 2:
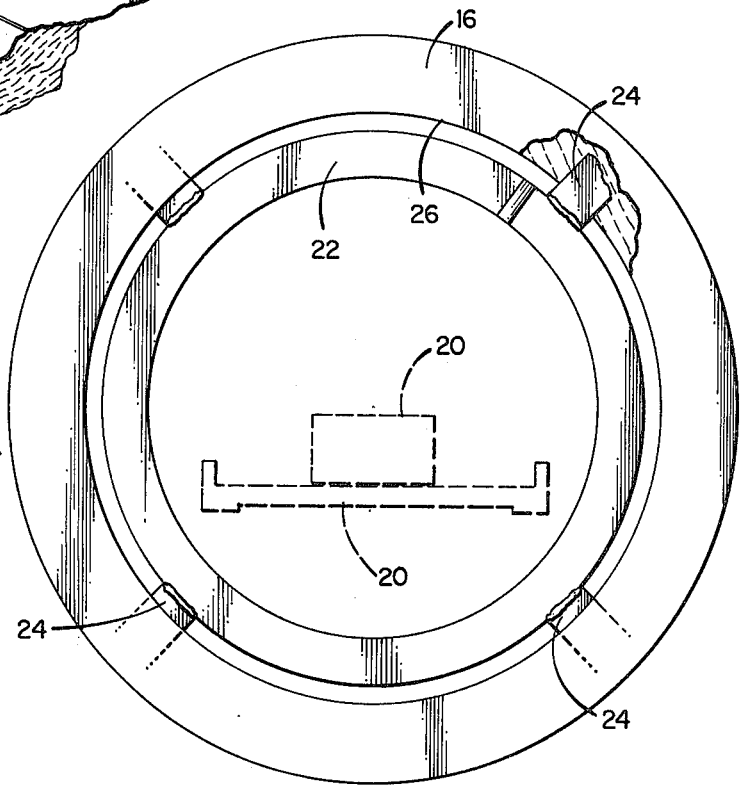
FIG. 2 is a plan view of the heating element of FIG. 1.
Figure 3:
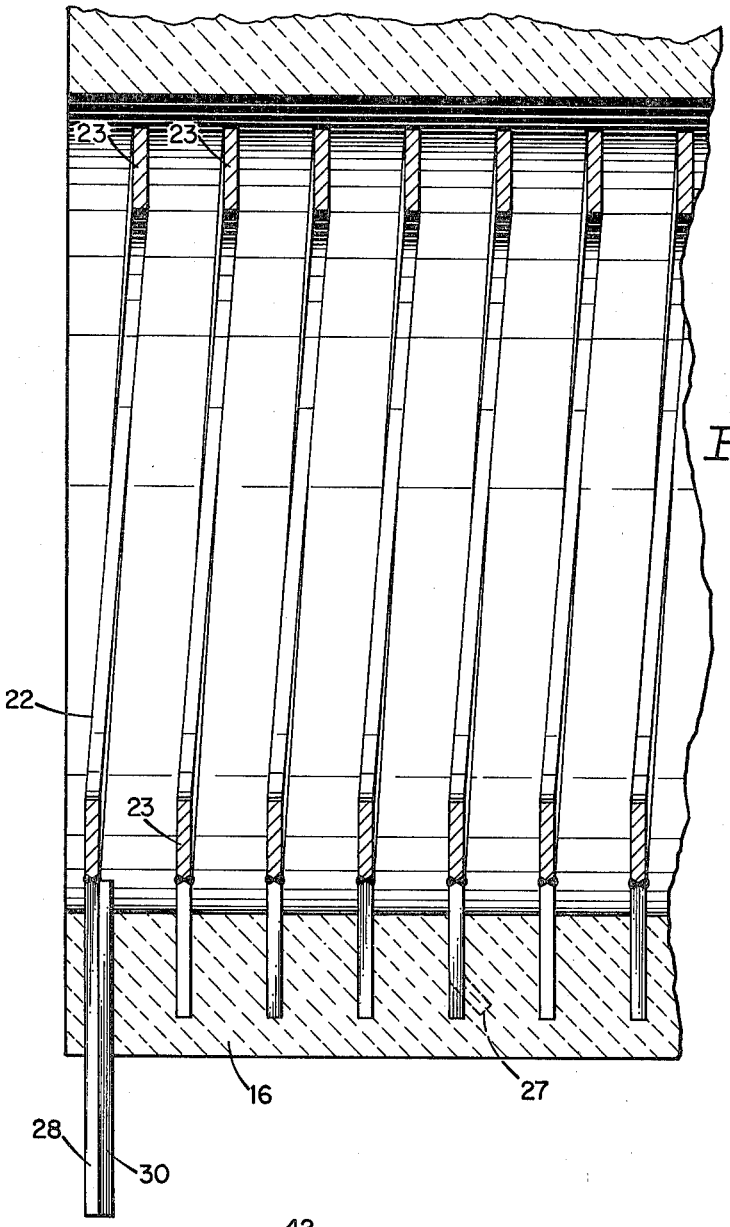
FIG. 3 is a sectional elevation view of the heating element of FIG. 1.

The heater is additionally shown in FIGS. 2 and 3 and comprises a flat continuous electrical resistor ribbon 22 wound into a helix of spaced multiple turns with the flat confronting surfaces 23 of the ribbon being generally transverse to the longitudinal axis of the helix. A plurality of legs or struts 24 are formed with or affixed to the ribbon 22 and outwardly extend from the outermost edge 25 thereof. These legs are disposed within and rigidly secured by the cylindrical refractory base 16, with the helical resistor ribbon 22 being spaced along its active length from the confronting surface 26 of cylinder 16. In the illustrated embodiment, the legs 24 are disposed on respective turns of helical ribbon 22 in four equispaced linear arrays along selected axes longitudinal with the helix.

The end portions of legs 24 within the cylinder 16 can be bent as shown in FIG. 3 by reference numeral 27 or can be flared or otherwise configured to enhance the mechanical retention of the legs and the integral ribbon 22 within the refractory support.

The resistor ribbon 22 is rigidly supported by cylinder 16, but is spaced from the cylinder such that the heater is entirely open to the furnace chamber without any surrounding ceramic mass as in conventional electrical heater structures.

Electrical connection is made to the heater 12 by electrical leads provided at the respective ends of the helically wound resistor ribbon 22. As seen in FIG. 3, one end of ribbon 22 terminates in an electrical terminal 28 to which an electrical cable from an external electrical power source (not shown) can be connected to energize the heater. Similarly, the other end of ribbon 22 terminates in a similar electrical terminal for connection to the energizing source. In order to reduce the electrical resistance of the electrical terminals and reduce the temperature of the terminals, an electrically conductive metal strap 30 can be welded to the terminals 28 of the heater to thereby provide a more efficient electrical terminal in well known manner.

The heater element 12 is typically formed from a nickel-iron-chromium alloy or iron-chromium-aluminum alloy when used for heating temperatures of about 1000°C and 1300°C, respectively, and when used for extremely high temperatures such as 1800°C, is typically formed or molybdenum or tungsten refractory metals.

The support cylinder 16 is preferably formed by casting of a suitable refractory material such as aluminum silicate which is hydraulically set and then fired. The legs 24 are of the same high temperature material as that of ribbon 22, and as noted above, these legs can be integrally formed with ribbon 22 or welded to the ribbon edge at intended locations. In the helical configuration of the embodiments of FIGS. 1-3, it is preferable to form the helix from a flat resistor ribbon without the encumbrance of projecting legs and to thereafter affix legs 24 to the turns of the helical resistor ribbon in predetermined arrangement such as in the linear arrays illustrated.

The legs 24 are of a number to rigidly support the ribbon 22 within refractory cylinder 16, but are of sufficiently small thermal mass to provide only limited paths for thermal conduction from ribbon 22 to the refractory cylinder 16. During high temperature operation of the heater, relatively little heat is conducted by legs 24 to cylinder 16. Thus, the refractory support, which is of considerable thermal mass, forms no material part of the thermal heater control and, as a result, the heater can be more readily cycled and controlled since the thermal inertia of the refractory support does not detract from overall thermal efficiency as in conventional heater constructions. When energized electrically and brought to the exceedingly high temperatures at which the novel heater is operative, the turns of ribbon 24 will expand and deform to effectively increase the radiating surface of the heater. The multiple turns of the heater are, however, retained throughout the heater length in rigid supported relationship by legs 24 and cooperative cylinder 16 with the overall heater being restrained from bending, sagging, twisting or buckling.

The resistor ribbon 22 in typical implementation is formed of a strip of five-eighth x one-eighth inch metal with legs 24 being typically one-eighth x one-fourth inch strips. The heating element is spaced and supported from the refractory base by typically one-sixteenth inch. The novel electrical heating element can be operated near the melting point of the ribbon material as the element is continuously supported by the legs 24 spaced along the entire active length of the element and rigidly affixed to the refractory base.

Figure 5:
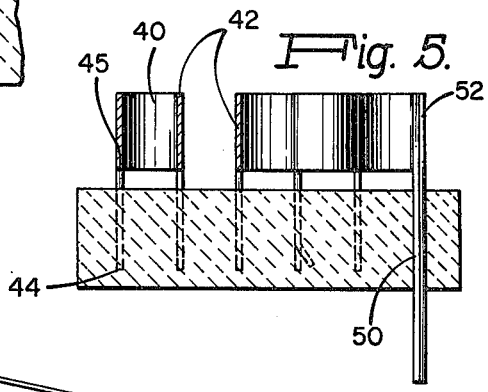
FIG. 5 is an elevation view of the embodiment of FIG. 4.
Figure 4:
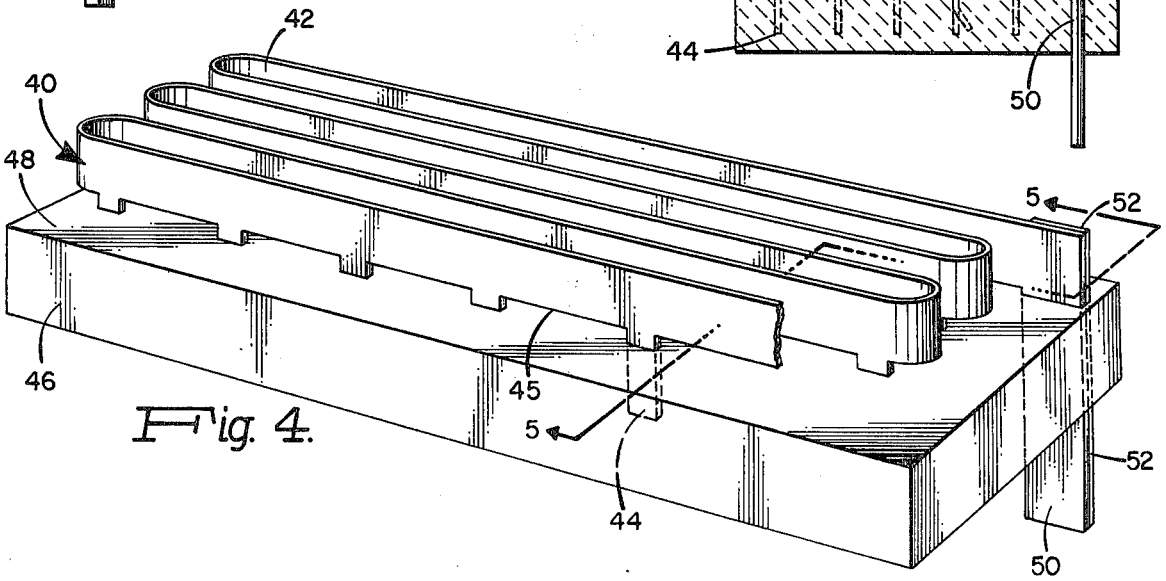
FIG. 4 is a pictorial representation of an alternative embodiment of a heating element constructed according to the invention.

An alternative embodiment of the invention is depicted in FIGS. 4 and 5 wherein is shown a heater of planar configuration. Referring to FIGS. 4 and 5, a flat continuous electrical resistor ribbon 40 is folded in a serpentine path having a plurality of loops composed of spaced generally parallel flat confronting surfaces 42. A plurality of legs 44 are formed with or affixed to ribbon 40 and extend from an edge 45 thereof outwardly in the planes of the confronting surfaces 42. The outer portions of legs 44 are rigidly secured in a refractory base or block 46 with ribbon 40 being along its active length upstanding and spaced from the confronting surface 48 of refractory base 46. As in the helical configuration described above, this planar configuration also provides an electrical resistance heater rigidly secured by a refractory support but with the heating element itself being entirely free of the support such that the support forms no substantial part of the thermal heater structure. The ribbon 40 terminates at its respective ends in first and second electrical terminals 50 to which a source of electrical energy can be coupled. As described above, conductive straps 52 can be welded to the terminals of the heater to lower the resistance thereof.

The heater of FIGS. 4 and 5 is disposed along with other like heaters within a furnace, the ribbon 40 being in an open exposed rotation to the furnace chamber for the efficient heating thereof. The heating element contains no refractory cores or supports within or surrounding the multiple loops thereof, the heater having a thermal efficiency substantially unaffected by the refractory support structure. The relatively little thermal conduction which does occur via legs 44 to base 46 offers no material impediment to the efficient thermal control of the open and unconfined heater formed by ribbon 40.

It will be apparent to those skilled in the art that the prinicples of this invention may be embodied in different configurations to suit particular thermal processing requirements. Accordingly, the invention is not to be limited by what has been particularly shown and described except as indicated in the appended claims.

What is claimed is:

1. An electrical resistance heater comprising:

an elongated flat continuous resistor ribbon disposed in a multiple loop configuration having a plurality of spaced segments with flat confronting surfaces;

a plurality of legs on said resistor ribbon and extending outwardly therefrom in the planes of said flat confronting surfaces;

a refractory electrically insulative base in which said legs are secured to maintain said resistor ribbon in spaced relationship to the confronting surface of said refractory base; and electrical connecting means for connection of the respective outer ends of said continuous resistor ribbon to an external electrical power source.

2. The electrical resistance heater of claim 1 wherein said continuous resistor ribbon is folded in a serpentine path to provide a multiple loop planar heater structure.

3. The electrical resistance heater of claim 1 wherein said continuous resistor ribbon is disposed in a helical path to provide a plurality of spaced helical turns defining a helical heater structure.

4. The electrical resistance heater of claim 1 wherein said plurality of legs are integrally formed with said resistor ribbon, each being spaced along the active length of said ribbon and extending from an edge thereof.

5. The electrical resistance heater of claim 1 wherein said plurality of legs are welded to an edge of said ribbon, each leg being spaced along the active length thereof.

6. The electrical resistance heater of claim 2 wherein said refractory electrically insulative base is of rectangular configuration and having said plurality of legs secured therein for support of said continuous resistor ribbon in a serpentine path above the confronting surface of said base.

7. The electrical resistance heater of claim 3 wherein said refractory electrically insulative base is of cylindrical configuration surrounding said helical heater structure, said plurality of legs being secured in said cylindrical base for support of said helical heater structure coaxially therein and spaced from the confronting surface of said cylindrical base.

8. The electrical resistance heater of claim 7 wherein said plurality of legs are disposed outwardly from said helical ribbon in a plurality of linear arrays, the arrays being circumferentially spaced from each other around said helical heater structure.

9. The electrical resistance heater of claim 6 wherein said plurality of legs are disposed outwardly from said ribbon in spaced array along straight portions of said serpentine path.

10. The electrical resistance heater of claim 1 wherein said refractory base is cast around said legs to secure said ribbon in spaced relationship to the confronting surface of said base.

11. The electrical resistance heater of claim 1 wherein said plurality of legs each have an end portion secured in said refractory base of configuration to enhance mechanical retention of the legs and ribbon within said base.

* * * * *